US008556580B2

(12) United States Patent
Stair et al.

(10) Patent No.: US 8,556,580 B2
(45) Date of Patent: Oct. 15, 2013

(54) SUBMERSIBLE PUMP FOR OPERATION IN SANDY ENVIRONMENTS, DIFFUSER ASSEMBLY, AND RELATED METHODS

(75) Inventors: Roger D. Stair, Claremore, OK (US); Wilson Lyle Brown, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 924 days.

(21) Appl. No.: 12/701,219

(22) Filed: Feb. 5, 2010

(65) Prior Publication Data

US 2011/0194926 A1 Aug. 11, 2011

(51) Int. Cl.
*F04D 17/12* (2006.01)

(52) U.S. Cl.
USPC ..... 415/199.2; 415/211.2

(58) Field of Classification Search
USPC ..... 415/199.2, 211.2, 206, 121.2; 416/198 R; 417/423.3
See application file for complete search history.

(56) References Cited

U.S. PATENT DOCUMENTS

| | | | | |
|---|---|---|---|---|
| 3,265,001 | A * | 8/1966 | Deters | 415/68 |
| 3,612,716 | A * | 10/1971 | Deters | 415/140 |
| 4,872,808 | A | 10/1989 | Wilson | |
| 6,676,366 | B2 | 1/2004 | Kao | |
| 6,726,449 | B2 | 4/2004 | James | |
| 2009/0047119 | A1 | 2/2009 | Bookout | |

* cited by examiner

*Primary Examiner* — Ninh H Nguyen
(74) *Attorney, Agent, or Firm* — Bracewell & Giuliani LLP

(57) ABSTRACT

Submersible pumps, diffuser assemblies, and related methods for pumping a fluid having a substantial sand content, are provided. A diffuser assembly for a submersible pump can include anti-swirl ribs forming sand dams positioned on an upper surface of the diffuser bowl floor at an acute angle to guide trapped between the bottom shroud of an impeller and the diffuser bowl to the inner surface of the diffuser bowl outer wall and back into the production fluid stream. The diffuser assembly can also include sand jump ramps each separately positioned adjacent the outer peripheral surface of one of the sand dams and positioned adjacent a separate portion of the inner surface of the diffuser bowl outer wall to further enhance deflection of sand back into the production fluid stream.

19 Claims, 9 Drawing Sheets

SUBMERSIBLE PUMP FOR OPERATION IN SANDY ENVIRONMENTS, DIFFUSER ASSEMBLY, AND RELATED METHODS

BACKGROUND OF THE INVENTION

1. Field of the Invention

The present invention relates generally to submersible downhole pumps. More particularly, the present invention relates to submersible pumps and diffuser assemblies for submersible downhole pumps configured for operation in sandy environments, and methods of pumping a fluid having a substantial sand content.

2. Description of the Related Art

When an oil well is initially completed, the downhole pressure may be sufficient to force the well fluid up the well tubing string to the surface. As the downhole pressure in some wells decreases, some form of artificial lift is required to transport the well fluid to the surface. One form of artificial lift is provided by suspending an Electrical Submersible Pump (ESP) downhole, normally on the tubing string. The ESP is a high speed rotating machine that provides the extra lift necessary for the well fluid to reach the surface. One type of ESP is a centrifugal pump.

Centrifugal pumps have a series of impellers inside of a tubular housing, which are rotated by a drive shaft in order to propel fluids from the radial center of the pump towards the tubular housing enclosing the impellers. The impellers have an inlet or an eye towards the radial center portion around the drive shaft. Spinning the impeller creates centrifugal forces on the fluid in the impeller. The centrifugal forces increase the velocity of the fluid in the impeller as the fluid is propelled towards the tubular housing.

The height that the fluid can travel in a passageway extending vertically from the exit portion of the impeller is the head generated from the impeller. A large amount of head is necessary in order to pump the well fluid to the surface. Either increasing the impeller diameter or increasing the number of impellers can increase the amount of head generated by a pump. The diameter of the impellers is, however, limited by the diameter of the well assembly. As such, the number of impellers is generally increased in order to generate enough head to pump the well fluid to the surface.

During operation, the well fluid enters a stationary diffuser after exiting the impeller. The fluid loses velocity in the diffuser because it is stationary. Decreasing the velocity of the fluid in the diffuser causes the pressure of the fluid to increase. The diffuser also redirects the fluid to the eye or inlet of the next impeller. Each impeller and diffuser combination together form a stage in the pump. The pressure increase from one stage is additive to the amount of head created in the next stage. After enough stages are transversed, the cumulative pressure increase on the well fluid is large enough that the head created in the last impeller pumps the well fluid to the surface.

Each impeller typically mounts directly to the drive shaft, but the diffusers generally slide over the drive shaft and land on the diffuser of the previous stage. A pre-load is applied so that this contact between the diffusers creates a large enough frictional force to prevent the diffusers from spinning with the drive shaft.

The ESPs are often deployed in a sandy, corrosive downhole environment. Various steps have to be taken in the design ESPs to allow for high sand content and the wear that sand particles can cause, to include the use of hardened coatings and abrasion resistant materials. Areas in the ESP that are filled with well fluid that is not in the designed flow path, such as the space between the bottom shroud of the impeller and the diffuser bowl, however, can be problematic. Sand particles can settle between the outer rim of the impeller bottom shroud and the diffuser inner wall where they are trapped in and will roll around until they disintegrate or cut their way through the diffuser wall.

Currently, there are two primary methods used to avoid this destruction. The first is to drill a small hole through the floor of the diffuser's bowl adjacent the inner diameter of the diffuser's bowl (axial wall). This "sand hole" can allow the sand to exit into the lower pressure area of the diffuser entrance. The second is to construct "anti swirl ribs" or "sand dams" in the bowl of the diffuser to keep the sand in place. These ribs look like small "speed bumps" placed radially in the bowl of the diffuser. Both of these methods work to some extent, but both can be over whelmed in some sandy conditions. The sand hole, for example, can erode and enlarge, reducing the efficiency of the ESP. The sand dams, for example, can erode at their outer edge cutting through the dam and eventually the diffuser wall and housing.

Recognized by the inventors therefore is the need for a diffuser (assembly) configured to reintroduce sand trapped between the bottom shroud of the impeller and the diffuser bowl, back into the flow path of the well fluid.

SUMMARY OF THE INVENTION

In view of the foregoing, various embodiments of the present invention advantageously provide diffuser assemblies, submersible pumps, and methods of pumping a fluid having a substantial sand content to include reintroducing sand trapped between the bottom shroud of an impeller and a diffuser bowl, back into the flow path of the production fluid within the pump.

More specifically, an example of an embodiment of a submersible pump for pumping a fluid having a substantial sand content includes multiple pump stages each containing an impeller assembly and a diffuser assembly. Each impeller assembly includes an upper impeller body, a lower impeller body, and a fluid channel formed therebetween. Each diffuser assembly, provided as part of the submersible pump, or as a separate assembly, contains a diffuser bowl including a diffuser bowl floor and a diffuser bowl outer wall extending axially from the diffuser bowl floor to house or otherwise contain the impeller assembly. Each diffuser assembly also contains a diffuser lower shroud which together with the diffuser bowl floor forms at least a portion of a fluid pathway for transporting fluid to the impeller assembly. Each diffuser assembly further contains a plurality of curved vanes connected to the distal (lower) surface of the diffuser bowl floor and positioned between the distal surface of the diffuser bowl floor and the proximal (upper) surface of the diffuser lower shroud to reduce kinetic energy of a primary fluid stream and to convert at least some of the kinetic energy to pressure (head), and a plurality of circumferentially spaced anti-swirl ribs or 'sand dams" each connected to the proximal (upper) surface of the diffuser bowl floor adjacent a separate portion of an inner surface of the diffuser bowl outer wall at an acute angle thereto to guide trapped sand particles to the inner surface of the diffuser bowl outer wall and into the primary fluid stream.

Each diffuser assembly can also include a plurality of tapered protuberances forming "sand jump ramps" each extending axially from the proximal surface of the diffuser bowl floor and being separately positioned adjacent an outer peripheral surface of a corresponding one of the plurality of sand dams and adjacent the separate portion of the inner surface of the diffuser bowl outer wall associated with the respective one of the plurality of sand dams to deflect the trapped sand particles into the primary fluid stream. In order to enhance the "jumping" effect, each sand jump ramp is generally oriented to extend circumferentially in an anticipated approximate upstream direction of sand particles expected to impact the respective sand jump ramp.

According to another configuration of the diffuser assembly, the inner surface of the diffuser bowl outer wall includes an annular groove extending along an inner circumference of the inner surface of the diffuser bowl outer wall adjacent an outer peripheral portion of each of the plurality of sand dams to enhance return of the trapped sand particles to the primary fluid stream. Additionally or alternatively, the diffuser assembly can include a plurality of sand hole recesses each extending through the distal surface of the diffuser bowl floor and into a portion of a corresponding one of the plurality of sand dams so that when the respective sand dam is substantially eroded, the sand hole recess forms a sand pathway therethrough to provide an exit pathway for the trapped sand particles.

Embodiments of the present invention also include methods of pumping a fluid having a substantial sand content. According to an example of an embodiment of such a method, the method can include the steps of providing a submersible pump assembly having a plurality of diffuser assemblies or diffusers each having a diffuser bowl including: a diffuser bowl floor and a diffuser bowl outer wall extending axially from the diffuser bowl floor. Each diffuser assembly can also include a plurality of spaced apart anti-swirl ribs or "sand dams" either indirectly connected to or integral with the upper surface of the diffuser bowl floor and positioned or otherwise positionable adjacent an inner surface of the diffuser bowl outer wall, preferably at an acute angle thereto to guide trapped sand particles to the inner surface of the diffuser bowl outer wall and into a primary fluid stream of fluid directed to a housed impeller assembly. Each diffuser assembly can also include a plurality of tapered protuberances or "sand jump ramps" extending axially from the upper surface of the diffuser bowl floor. Each sand jump ramp is separately positioned or is otherwise positionable adjacent, e.g., an outer peripheral surface of a corresponding one of the sand dams and adjacent a separate portion of the inner surface of the diffuser bowl outer wall adjacent the associated sand dam to deflect trapped sand particles into the primary fluid stream.

The method can also include the steps of guiding sand particles to at least one of the sand dams, and deflecting trapped sand particles trapped between a portion of a lower impeller shroud/body and the inner surface of the diffuser bowl outer wall and/or upper surface of the diffuser bowl floor to an area between the lower impeller shroud/body and the inner surface of the diffuser bowl outer wall and axially into the primary fluid stream According to an embodiment of the method, the step of deflecting trapped sand particles further includes deflecting the trapped sand particles into a relatively small annular groove in the inner surface of the diffuser bowl outer wall. Other method steps can include establishing provisions for sand erosion, alternate avenues of disposing of the sand particles, and/or other enhancements described below.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Figure 1:
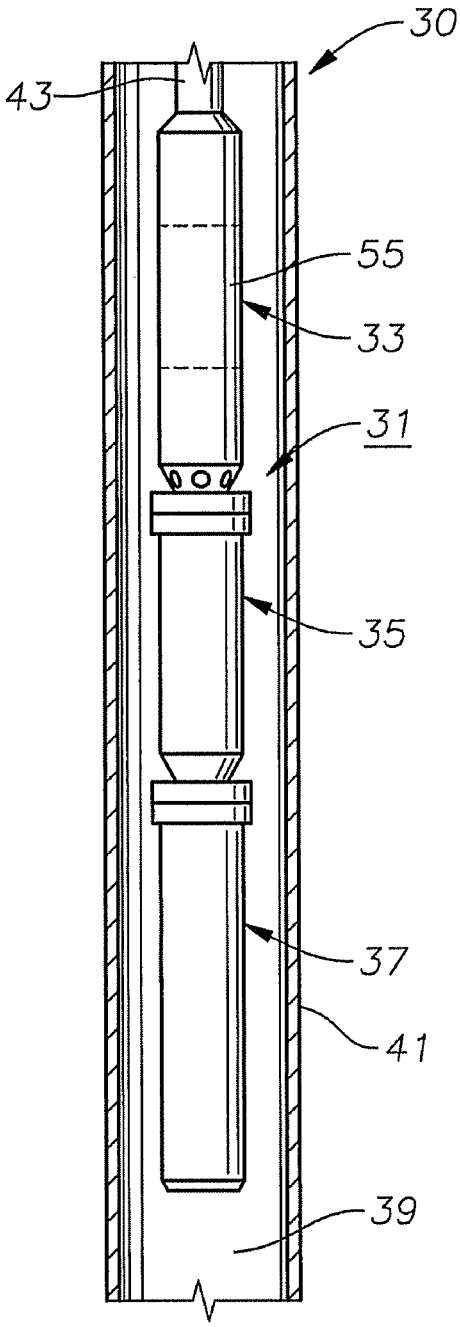
FIG. 1 is a perspective view of a centrifugal pump disposed in a fluid within a well having a high sand content according to an embodiment of the present invention.

FIG. 1 generally depicts a well 30 with a submersible multi-stage pump assembly 31 installed within. The pump assembly 31 includes, for example, a centrifugal pump 33 that has a seal section 35 attached thereto and an electric motor 37, together submerged in a well fluid 39. The shaft of motor 37 connects to the seal section shaft (not shown) which is connected to the centrifugal pump 33. The pump assembly 31 and well fluid 39 are located within a casing 41, which is part of the well 30. Pump 33 connects to tubing 43 to convey the well fluid 39 to a storage facility (not shown).

According to an exemplary configuration, the motor 37 is a three-phase AC motor that rotates at a speed dependent on the frequency of the electrical power supplied to it. For example, motor 37 can be driven by a fixed 60 Hz power supply. According to another configuration, a variable speed drive system can be employed with motor 37. Variable speed drive systems are conventional and allow an operator to change the frequency of the power supplied to motor 37, and thus, the rotational speed of pump 33. If used, the operator will select a frequency for the variable speed drive based on expected conditions of the well 30. Pump 33 will then rotate at the selected speed until the operator subsequently decides to change the speed. Even if used with a variable speed drive system, normally, the pump assembly 31 does not employ a feedback circuitry to automatically change the frequency of the variable speed drive based on load or other factors. Consequently, pump assembly 31 is typically operated at a constant speed, even though the operator may from time to time change that speed. Further, the sizes of motor 37 and pump 33 are selected based on the depth of the pump 33 and viscosity of the fluid 39.

Figure 2:
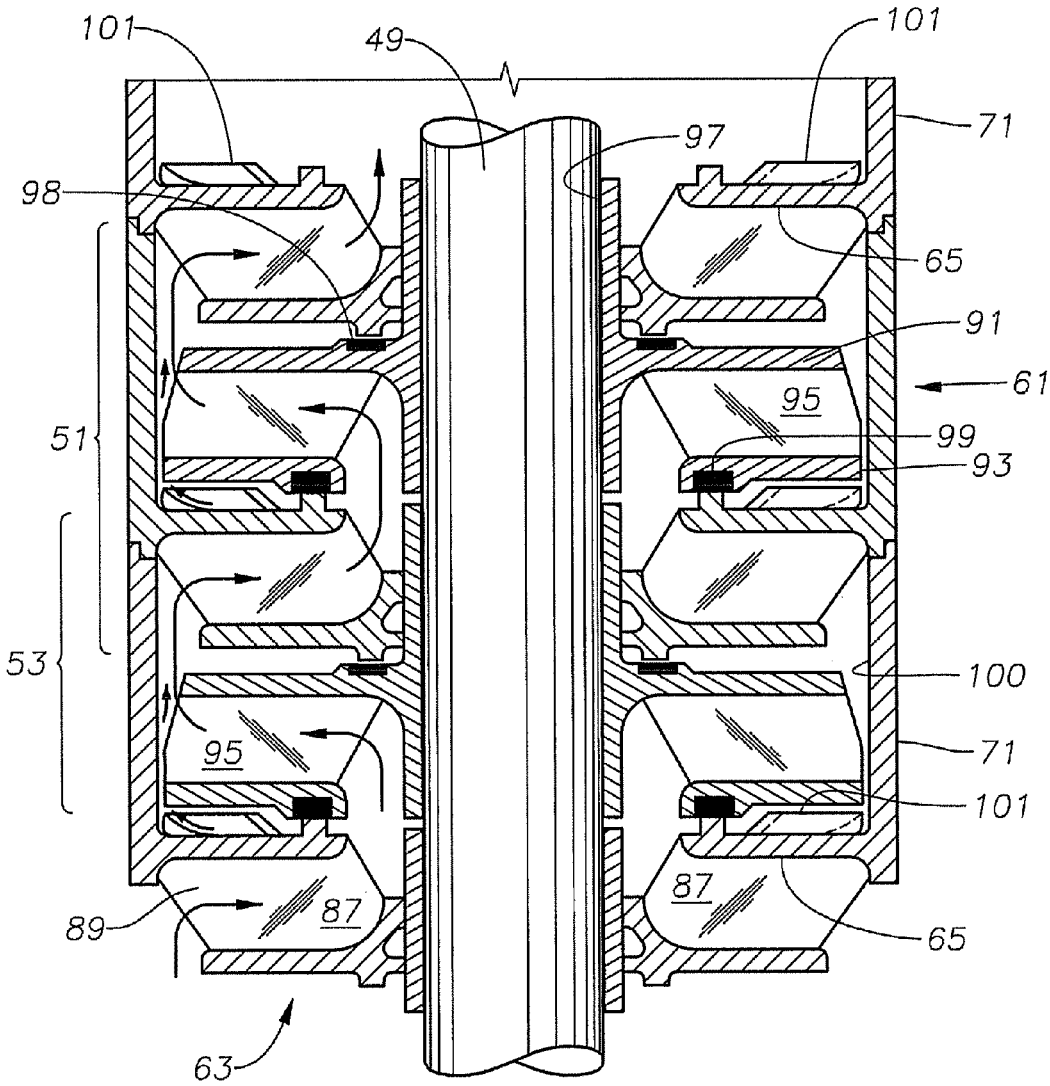
FIG. 2 is a partial cross-sectional view of two stages of the centrifugal pump of FIG. 1 including both impeller and diffuser assemblies according to an embodiment of the present invention.

Referring to FIG. 2, the centrifugal pump 33 contains a shaft 49 that extends longitudinally through the pump 33, a plurality of stages of combined diffuser and impeller assemblies 51, 53, and a housing 55 (see FIG. 1) that protects many of the pump components.

Figure 3:
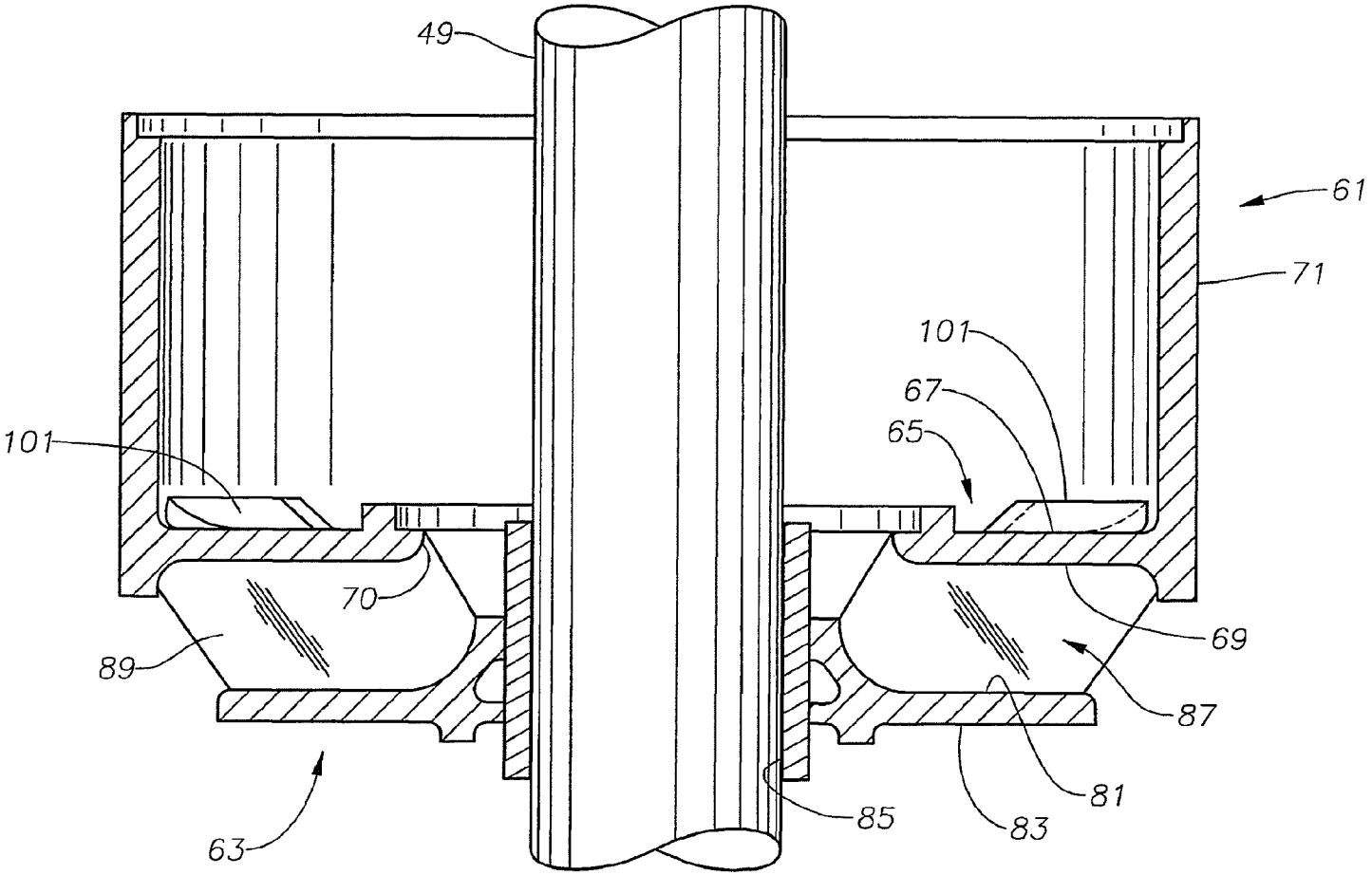
FIG. 3 is a partial cross-sectional view of a diffuser assembly of a centrifugal pump according to an embodiment of the present invention.

Also referring to FIG. 3, each diffuser assembly 51 includes a diffuser bowl 61 and a diffuser lower shroud 63. The diffuser bowl 61 includes a diffuser bowl floor 65 which has an upper or proximal surface 67, a lower or distal surface 69, and a bore 70 extending therethrough for receiving the shaft 49 and/or portions of the impeller assembly 53. A diffuser bowl outer wall 71 extends axially from the upper surface 67 of the diffuser bowl floor 65 to house the impeller assembly 53. The diffuser lower shroud 63 includes an upper surface 81, a lower surface 83, and a bore 85 extending therethrough for receiving the shaft 49 and/or portions of the impeller assembly 53. The lower surface 69 of the diffuser bowl floor 65 and the upper surface 81 of the diffuser lower shroud 63 form a fluid pathway 87 which provides at least a portion of a fluid pathway to the impeller assembly 53. The diffuser assembly 51 can also include multiple curved vanes 89 (see, e.g., FIG. 5) that extends helically outward from a central area to define multiple diffuser passages which channel the fluid 39 to the impeller assembly 53. Note, the illustrated diffuser assembly 51 is a radial flow type, with passages extending in a radial plane. One of ordinary skill in the art would understand that direct application to mixed flow type diffusers is within the scope of the present invention.

Referring again to FIG. 2, an impeller assembly 53 is positioned or otherwise contained within each diffuser assembly 51. Each impeller assembly 53 includes an upper impeller body 91, a lower impeller body or disc 93 often referred to as an impeller shroud, and a fluid pathway 95 formed therebetween. A bore 97 extends the length of impeller assembly 53 and is at least partially engaged with shaft 49 for rotation of the assembly 53 relative to the diffuser assembly 51. The fluid pathway 95 of each impeller assembly 53 can contain individual passages that correspond to the fluid channels in the associated diffuser assembly 51. Washers/seals 98, 99 are placed between the upper and lower portions of the impeller assembly 53.

In operation, a first stage impeller assembly 53 rotates with shaft 49, which increases the velocity and kinetic energy of the fluid 39 as the fluid 39 is discharged radially outward through fluid pathway 95. The discharged fluid 39 then flows inward through fluid pathway 87 of a diffuser assembly 51 which is located axially above fluid pathway 95 of the impeller assembly 51, which causes the velocity of the fluid 39 to slow and to convert energy in the fluid 39 to potential energy. The fluid 39 then is returned to the intake of the next stage impeller assembly 53. This is accomplished for successive stages of diffuser and impeller assemblies 51, 53, to increase the pressure of the fluid 39 to the desired pressure.

Clearances between rotating and stationary pump components are also optimized to minimize the effect of boundary layer losses on non-pumping surfaces. As such, the fluid 39 can experience certain "dead zones" where fluid and/or fluid impurities such as sand can be trapped and/or held in vortices created by the movement of the fluid 39. The space between the lower impeller body or disc 93 of the impeller assembly 53 and the diffuser bowl outer wall 71 and/or upper surface of the diffuser bowl floor 65 can be particularly problematic. Particularly, sand particles can settle between the outer peripheral rim and/or lower surface of the lower impeller body 93 adjacent the outer peripheral rim and the inner surface 100 of the diffuser bowl outer wall 71 and/or upper surface of the diffuser bowl floor 65 adjacent thereto where they are trapped in and will roll around until they disintegrate or cut their way through the diffuser bowl outer wall 71 and/or diffuser bowl floor 65. In order to compensate for this problem, beneficially, various embodiments of the present invention include multiple spaced apart anti-swirl ribs or sand dams 101 (see, e.g., FIGS. 2-5).

Figure 4:
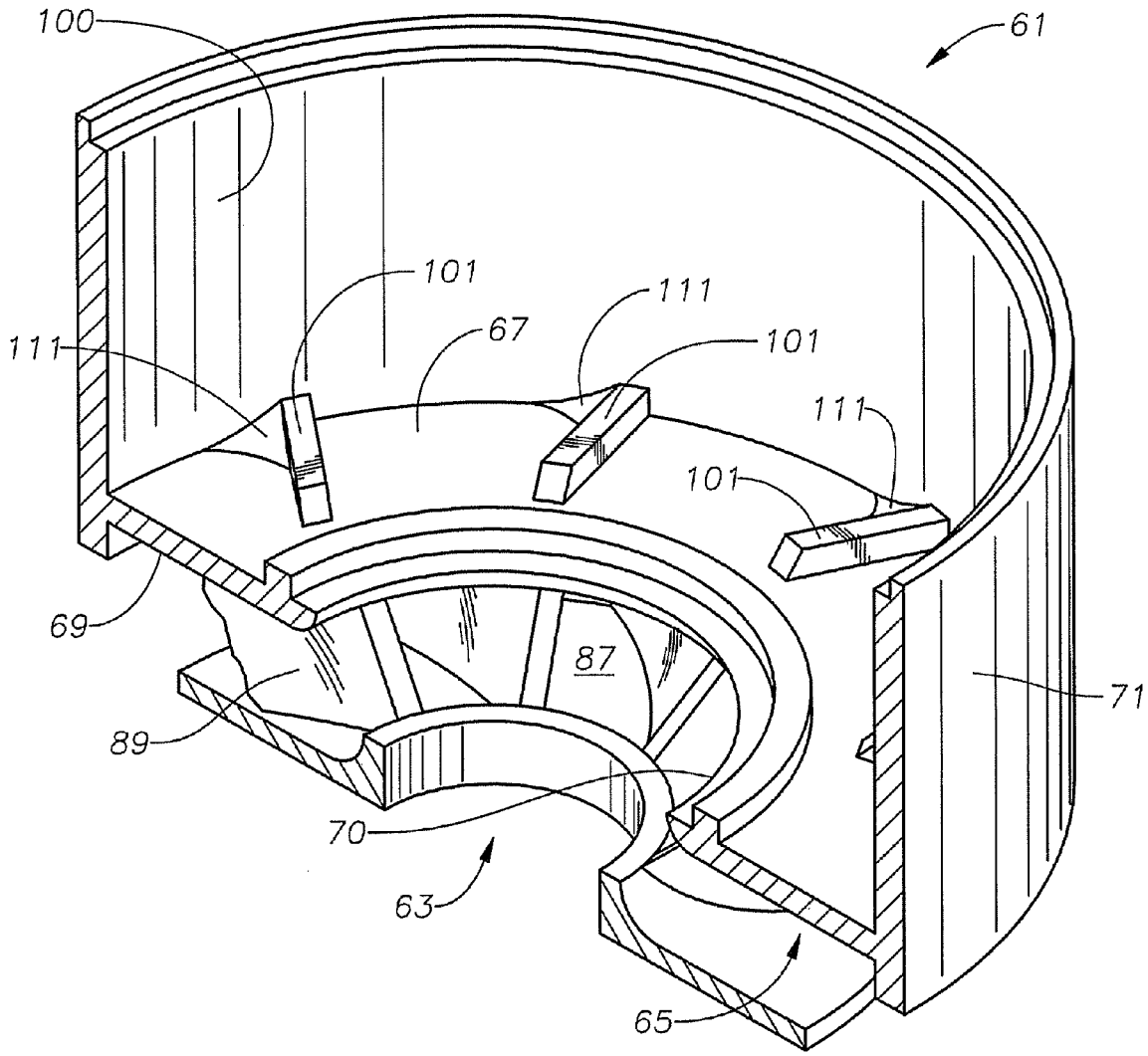
FIG. 4 is a perspective view of a partial cutaway of a diffuser bowl having anti-swirl ribs and associated sand jump ramps according to an embodiment of the present invention.

As perhaps best shown in FIG. 4, each diffuser bowl 61 can include a plurality of such circumferentially spaced sand dams 101 connected to the upper surface 67 of the diffuser bowl floor 65 adjacent the inner surface 100 of the diffuser bowl outer wall 71 to guide sand to the inner surface 100 of the diffuser bowl outer wall 71 and back into the stream of well fluid 39 (see, e.g., FIG. 7) passing through the pump 33. Note, although illustrated in rectangular form, one of ordinary skill in the art would understand the illustration of the sand dams 101 to represent various different geometric configurations including, but not limited to, those of a trapezoid or other quadrilateral, an object having a hemispherical or half cylindrical (convex) shape, etc.

Figure 5:
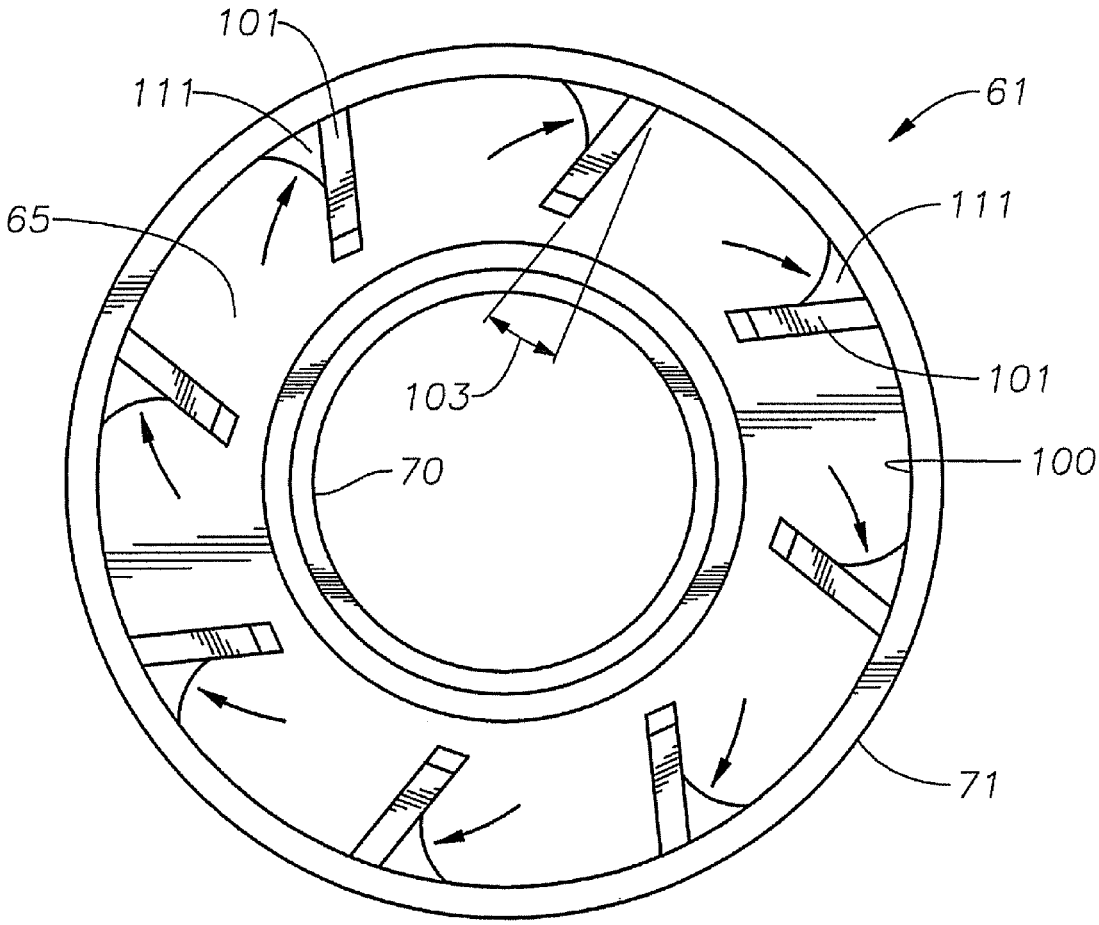
FIG. 5 is a perspective plan view of a diffuser bowl having anti-swirl ribs and associated sand jump ramps according to an embodiment of the present invention.

As further shown in FIG. 5, according to a preferred configuration, each of the sand dams 101 is positioned adjacent the inner surface 100 of the diffuser bowl outer wall 71 preferably at an acute angle 103 of less than 90 degrees, but more preferably less than 60 degrees, and even more preferably between 30 degrees to 60 degrees to the tangent to the portion of the inner surface 100 of the diffuser bowl outer wall 71 directly adjacent the respective sand dam 101 to guide sand to the inner surface 100 of the diffuser bowl outer wall 71 and back into the primary fluid stream of the fluid 39 within the pump 33.

Figure 6:
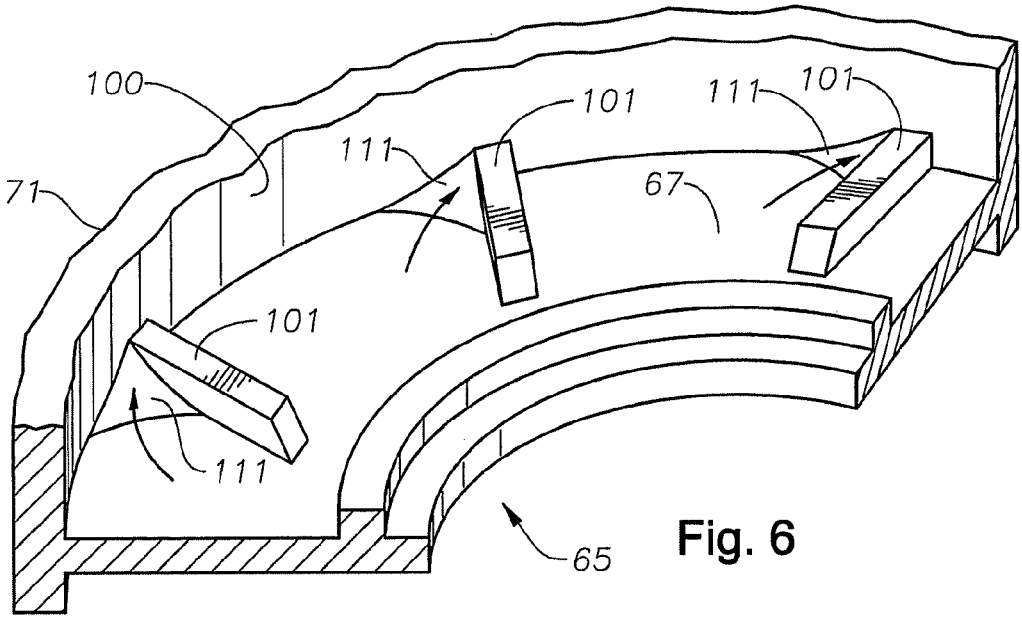
FIG. 6 is a perspective view of a partial cutaway of a diffuser bowl having anti-swirl ribs and associated sand jump ramps according to an embodiment of the present invention.
Figure 7:
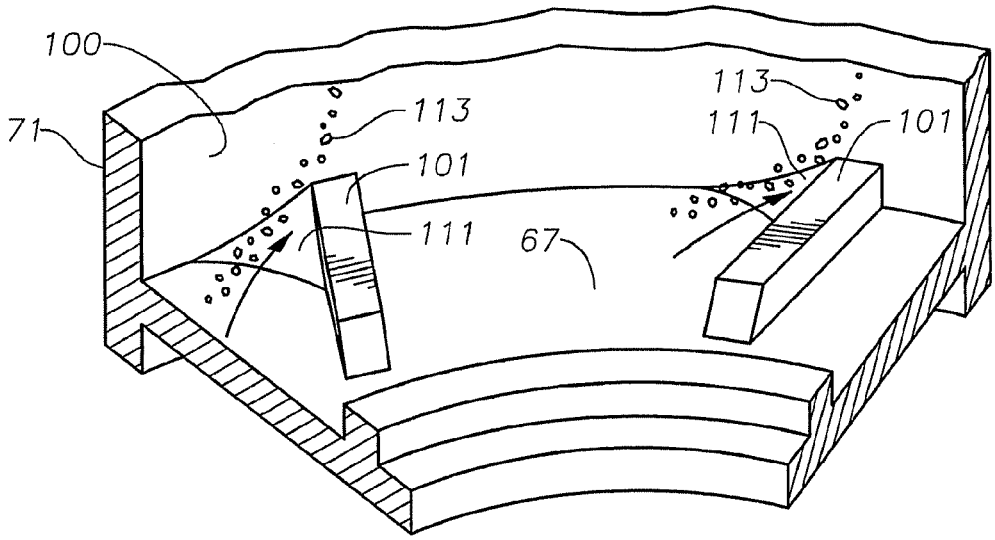
FIG. 7 is a perspective partially cut away view of a diffuser bowl floor having anti-swirl ribs and associated sand jump ramps illustrating deflection of trapped sand according to an embodiment of the present invention.

As further shown in FIGS. 6-7, the diffuser bowl floor 65 of each diffuser bowl 61 can further include a plurality of tapered protuberances defining sand jump ramps 111 extending axially from the upper surface 67 of the diffuser bowl floor 65. Each sand jump ramp 111 is separately positioned adjacent an outer peripheral surface of a corresponding one of the sand dams 101 adjacent a separate portion of the inner surface 100 of the diffuser bowl outer wall 71 adjacent with the respective sand jump ramp 111 to enhance the deflection of trapped sand into the fluid stream. According to a preferred configuration, each of the sand jump ramps 111 is further oriented to extend circumferentially in an anticipated approximate upstream direction of sand particles 113 (see FIG. 7). As illustrated, each sand jump ramp 111 can be tapered both radially and axially in an anticipated approximate upstream direction of sand particles 113 to enhance the application of a velocity component in the axial direction of the sand particles 113 while minimizing erosion to the ramp 111 and/or sand dam 101.

Figure 8:
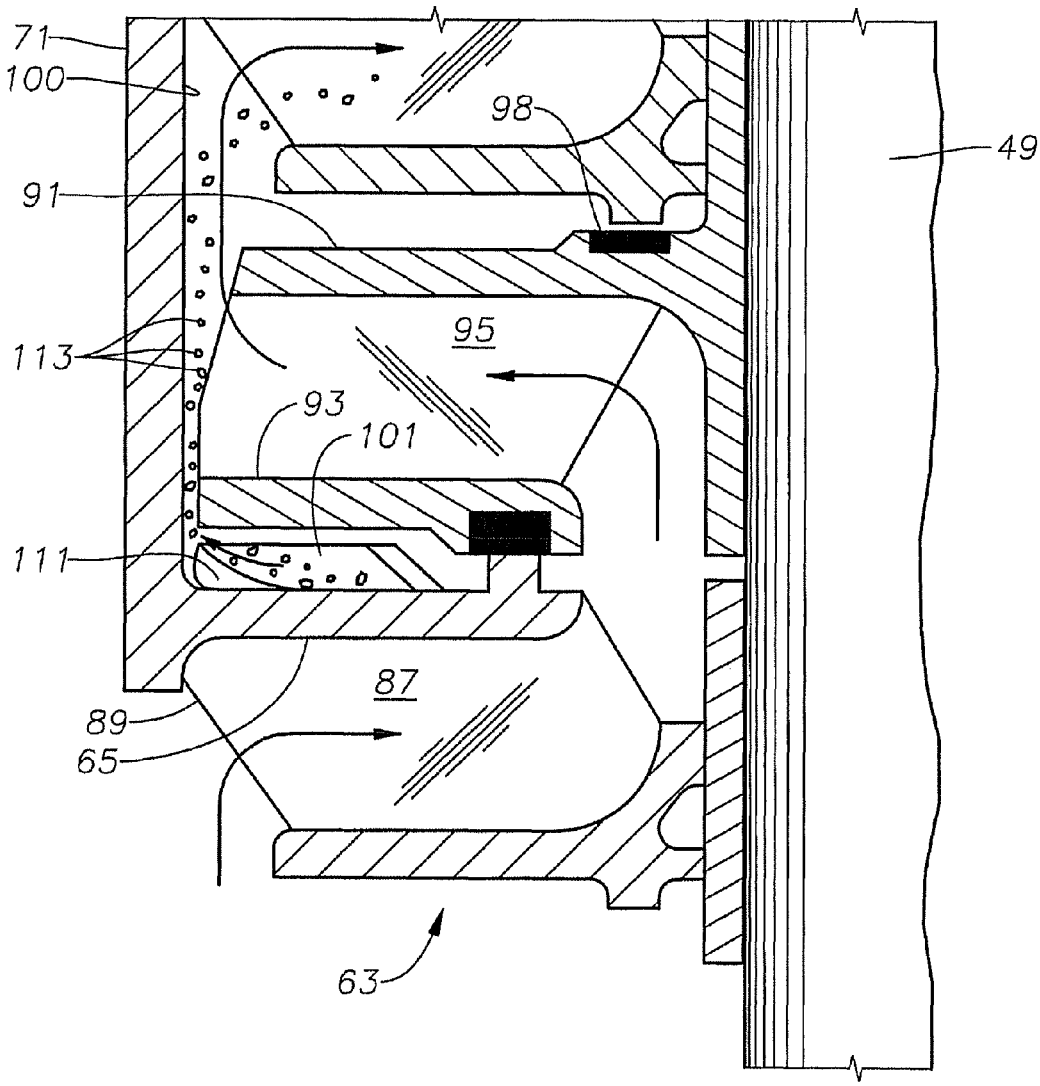
FIG. 8 is a partial cross-sectional view of a diffuser assembly illustrating deflection of trapped sand according to an embodiment of the present invention.

FIGS. 7-8 illustrate the deflection of the sand particles 113 along a portion of the sand ramp 111 and into the inner surface 100 of the diffuser bowl outer wall 71 under normal operating conditions. In this embodiment of the present invention, when the sand particles 113 impact the sand jump ramp 111 they bounce or "jump" in the direction of the small space between the lower impeller body 93 and the diffuser bowl outer wall 71 and back into the primary fluid stream.

Note, although illustrated adjacent an outer peripheral portion of each sand dam 101, one or more of the sand jump ramps 111 can extend radially inward to the full radial length of the sand dam 101 or to a location of a medial portion therebetween, depending upon the anticipated location and direction of the sand particles 113 when contacting the sand jump ramp 111.

Figure 9:
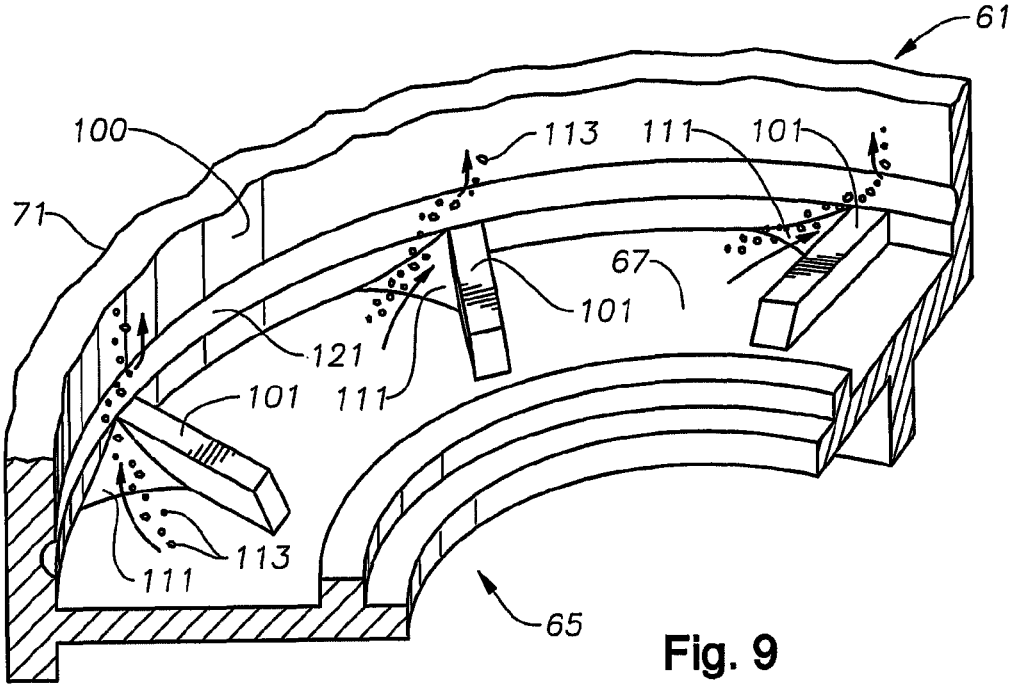
FIG. 9 is a perspective partially cut away view of a diffuser bowl illustrating an annular groove provided to enhance sand deflection according to an embodiment of the present invention.

FIG. 9 illustrates an embodiment of the present invention whereby the inner surface 100 of the diffuser bowl outer wall 71 includes an annular groove 121 extending along the inner circumference of the inner surface 100 of the diffuser bowl outer wall 71 adjacent an outer peripheral portion of each of the sand dams 101 to further enhance the ability of the sand dam 101 to evacuate trapped sand particles 113 from the area, and to thus, return the trapped sand particles 113 to the fluid stream.

Figure 10:
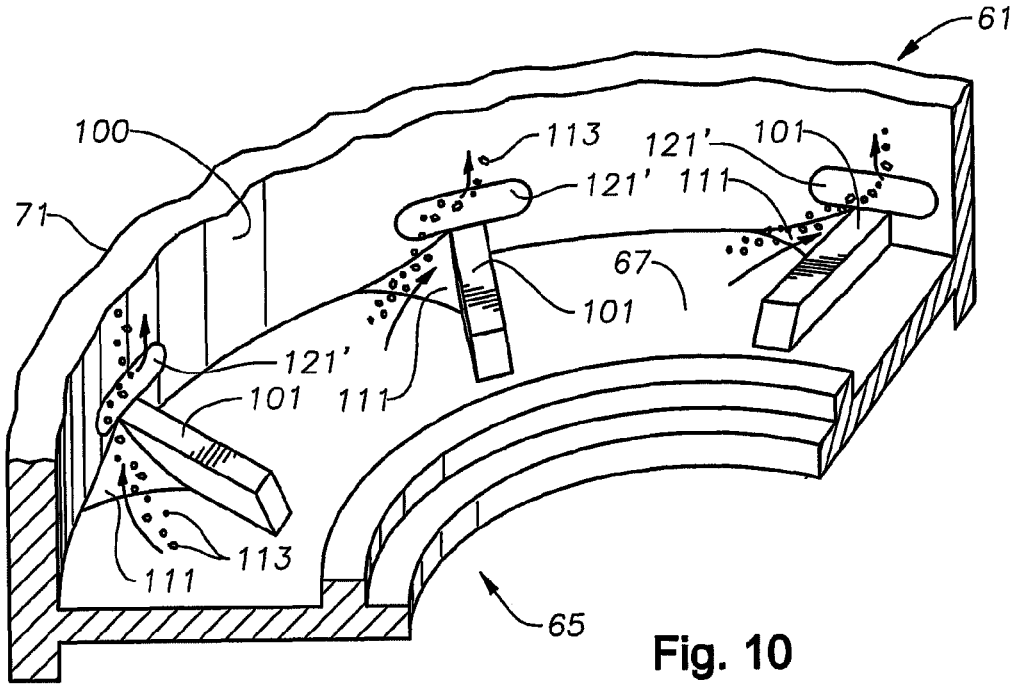
FIG. 10 is a perspective partially cut away view of a diffuser bowl illustrating an intermittent annular groove provided to enhance sand deflection according to an embodiment of the present invention.

FIG. 10 illustrates another embodiment of the present invention whereby the inner surface 100 of the diffuser bowl outer wall 71 includes a plurality of recesses 121' each spaced apart circumferentially and positioned adjacent an outer peripheral portion of one of the sand dams 101 to further enhance the ability of the sand dam 101 to evacuate trapped sand particles 113 from the area, and to thus, return the trapped sand particles 113 to the production fluid stream.

Figure 11:
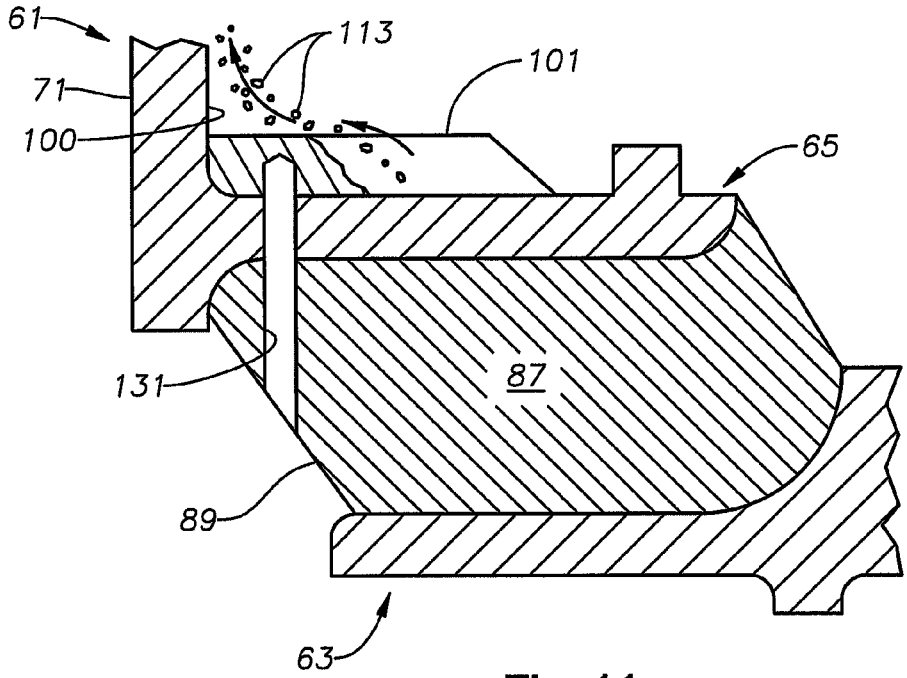
FIG. 11 is a perspective partially cut away view of a diffuser bowl illustrating a sand hole recess extending through the diffuser vanes, the diffuser bowl floor, and partially through the anti-swirl ribs according to an embodiment of the present invention.

FIG. 11 illustrates an embodiment of the present invention that includes a modified version of a sand hole in the form of a sand hole recesses 131 extending upwardly through one of the spaced apart curved diffuser vanes 89, the diffuser bowl floor 65, and partially through an adjacent one of the sand dams 101. This structural feature can be provided by drilling or otherwise forming the sand hole recess 131, for example, through an adjacent vane 89 from the lower side of the diffuser bowl floor directly under the intersection of the sand dam 101 and the inner surface 100 of the diffuser bowl outer wall 71. According to the illustrated configuration, the sand hole recess 131 is not drilled or otherwise formed all the way through the sand dam 101, and thus, does nothing until the sand particles 113 sufficiently erode the sand dam 101 to the point that the sand hole recess 131 is opened.

Figure 12:
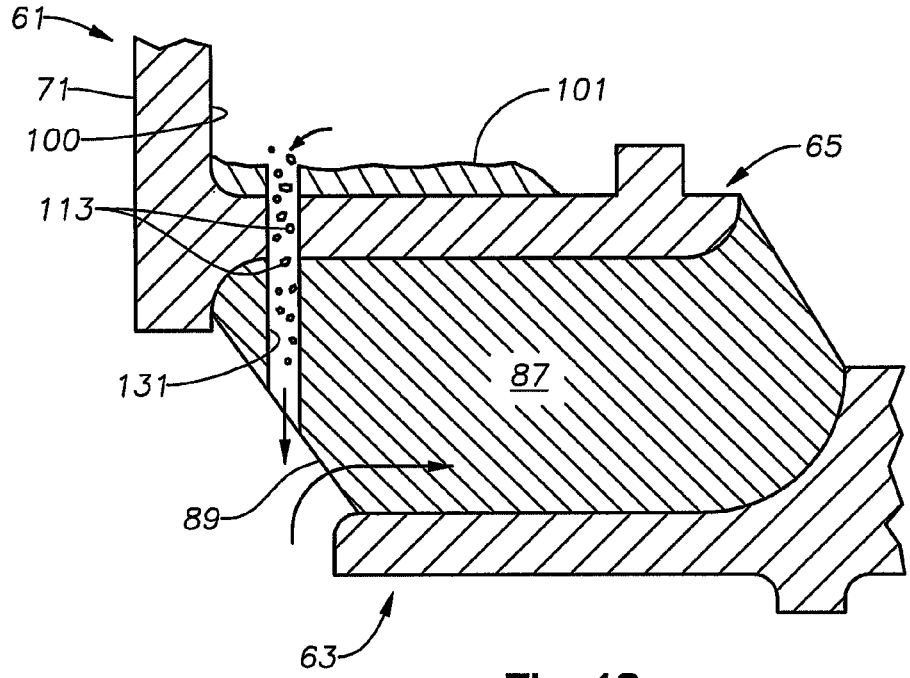
FIG. 12 is a perspective partially cut away view of a diffuser bowl and diffuser lower shroud illustrating sand particles traveling through the sand hole recess in response to erosion of the anti-swirl ribs according to an embodiment of the present invention.

As shown in FIG. 12, when opened, the sand hole recess 131 forms a sand pathway through the diffuser bowl floor 65 so that the sand particles 113 can than pass into the fluid stream in the fluid channel 87 below the diffuser bowl floor 65. Beneficially, this can reduce the possibility of the sand particles 113 cutting through the diffuser bowl floor 65 and/or diffuser bowl outer wall 71.

Note, it should be understood that various other configurations such as, for example, configurations created by drilling or otherwise forming each sand hole recess 131 so that the recess 131 extends through a sand jump ramp 111 rather than a portion of the sand dam 101, and/or extends in between adjacent diffuser vanes 89 rather than through an adjacent diffuser vane 89, are within the scope of the present invention. Further, the depth of each sand hole recess 131 into the sand dam 101 and/or sand jump ramp 111 can depend upon the type of material used to form the sand dam 101 and/or sand jump ramp 111, and/or can depend upon whether the sand dam 101 and/or sand jump ramp 111 are integral components with the upper surface 67 of the diffuser bowl floor 65 or are inserts of a hardened material that could be either snapped in place or fastened in place with screws or braising, etc.

Embodiments of the present invention also include methods of pumping a fluid 39 having a substantial sand content. According to an example of an embodiment of such a method, the method can include the steps of providing a submersible pump assembly 31, such as, for example, that shown in FIGS. 1-3, having a plurality of diffuser assemblies or diffusers 51 each having a diffuser bowl 61 including: a diffuser bowl floor 65 having an upper (proximal) surface 67 and a lower (distal) surface 69, and a diffuser bowl outer wall 71 extending axially from the upper surface 67 of the diffuser bowl floor 65. Each diffuser assembly 31 can also include a plurality of spaced apart anti-swirl ribs or sand dams 101 indirectly connected to or integral with the upper surface 67 of the diffuser bowl floor 65 and positioned or otherwise positionable adjacent an inner surface 101 of the diffuser bowl outer wall 71, preferably at an acute angle thereto to guide sand particles 113 to the inner surface 100 of the diffuser bowl outer wall 71 and into the fluid stream of fluid 39 entering a housed impeller assembly 53. Each diffuser assembly 51 can also include a plurality of tapered protuberances extending axially from the upper surface 67 of the diffuser bowl floor 65 to form a corresponding plurality a sand jump ramps 111 (see, e.g., FIGS. 4-6). Each sand jump ramp 111 is separately positioned or is otherwise positionable adjacent, e.g., an outer peripheral surface of a corresponding one of the sand dams 101 and adjacent a separate portion of the inner surface 100 of the diffuser bowl outer wall 71 adjacent the associated sand dam 101 to deflect sand particles 113 into the fluid stream (see, e.g., FIGS. 7-8).

The method also includes the steps of guiding sand particles 113 to at least one of the sand dams 101, and deflecting trapped sand particles 113 trapped between the outer rim and/or lower surface of an impeller shroud (e.g. impeller body or disc 93) adjacent thereto and the inner surface 100 of the diffuser bowl floor 65 and/or upper surface 67 adjacent thereto, to an area between the impeller body or disc 93 and the inner surface 100 of the diffuser bowl outer wall 71 and into the fluid stream adjacent fluid passageway 95 (see, e.g., FIGS. 2 and 7). According to an embodiment of the method, the step of deflecting trapped sand particles 113 includes deflecting the trapped sand particles into a relatively small annular groove 121 in the inner surface 100 of the diffuser bowl outer wall 71 (see, e.g., FIGS. 9-10).

The method can also or alternatively include forming or otherwise providing each sand dam 101 with a sand hole recess 131 extending through the lower surface 69 of the diffuser bowl floor 65 and into an outer peripheral portion of the respective sand dam 101 so that when the sand dam 101 is substantially eroded the sand hole recess 131 forms a sand pathway therethrough (see, e.g., FIG. 11). Accordingly, as perhaps best shown in FIG. 12, the method can also include passing trapped sand particles 113 into the fluid channel 87 in an adjacent diffuser assembly 51 responsive to sand particles 113 eroding the outer peripheral portion of the sand dam 101 having the sand hole recess 131 extending therein.

The various embodiments of the present invention have several advantages. For example, an embodiment of the present invention provides a modification of the anti-swirl ribs known as sand dams that are not radial, but instead, intersect the inside wall of the diffuser bowl at an angle. The angle can advantageously be selected so that the swirling sand is guided to the inside wall of the diffuser bowl. Additionally or alternatively, the floor of the diffuser bowl can be ramped upward at the intersection of the sand dam and the diffuser bowl outer wall so that the sand dam directs the sand particles up the sand jump ramp. When the particles impact the sand jump ramp, they can bounce or "jump" in the direction of the small space between the impeller shroud (lower impeller body or disc) and the diffuser bowl outer wall and back into the primary fluid stream. Another embodiment of the present invention further includes the addition of a small groove in the diffuser bowl outer wall at the end of the sand jump ramp section positioned to open the area where the sand is attempting to return to the fluid stream. Advantageously, this can significantly increase the dam's ability to evacuate the sand particles from the area. Another embodiment of the present invention includes a modified version of a sand hole extending into a portion of the sand dam or sand jump ramp. Advantageously, the modified sand hole is not drilled all the way through the sand dam, and thus, does nothing until the sand erodes the sand dam to the point that the sand hole is opened, thereby reducing the possibility of the sand cutting through the diffuser bowl floor or diffuser outer wall once substantial erosion has occurred. According to another embodiment of the present invention, rather than providing the sand dams and/or sand jump ramps as integral components of the diffuser bowl, the sand dams and/or sand jump ramps can be formed as inserts of a hardened material that could be either snapped in place or fastened in place with screws or braising, etc.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, various modifications can include employment of a sand hole recess and/or a sand jump ramp with or without application of a sand dam and/or employment of one or more such features with a sand dam oriented with the longitudinal axis in a radial orientation.

That claimed is:

1. A diffuser assembly for a submersible multistage pump for pumping a fluid having a substantial sand content, the diffuser assembly configured to house an impeller assembly having an upper impeller body, a lower impeller body and a fluid passageway formed therebetween, the diffuser assembly further comprising:

a diffuser bowl including:

a diffuser bowl floor having a proximal surface, a distal surface, and a bore extending therethrough for receiving a shaft of a multistage pump, and a diffuser bowl outer wall extending axially from the diffuser bowl floor to house the impeller assembly;

a plurality of circumferentially spaced anti-swirl ribs defining a plurality of sand dams connected to the proximal surface of the diffuser bowl floor, each of the plurality of sand dams positioned adjacent a separate portion of an inner surface of the diffuser bowl outer wall at an acute angle thereto to guide trapped sand particles to the inner surface of the diffuser bowl outer wall and into a primary fluid stream; and a plurality of tapered protuberances extending axially from the proximal surface of the diffuser bowl floor defining a corresponding plurality of sand jump ramps, each sand jump ramp separately positioned adjacent an outer peripheral surface of a corresponding one of the plurality of sand dams and positioned adjacent the separate portion of the inner surface of the diffuser bowl outer wall associated with the respective one of the plurality of sand dams to deflect the trapped sand particles into the primary fluid stream.

2. The diffuser assembly as defined in claim 1, wherein each of the plurality of sand dams have an outer peripheral portion, an inner peripheral portion, and a body extending therebetween; and wherein the outer peripheral portion of the each of the plurality of sand dams is positioned radially downstream of the inner peripheral portion of the respective sand dam.

3. The diffuser assembly as defined in claim 1, wherein each of the plurality of sand dams has an average longitudinal orientation of between approximately 0 to 60 degrees to a tangent to the separate portion of the inner surface of the diffuser bowl outer wall adjacent the respective sand dam.

4. The diffuser assembly as defined in claim 1, wherein each of the plurality of sand dams has an average longitudinal orientation of between approximately 30 to 60 degrees to a tangent to the separate portion of the inner surface of the diffuser bowl outer wall adjacent the respective sand dam.

5. The diffuser assembly as defined in claim 1, wherein the diffuser assembly further comprises:

a diffuser lower shroud having a proximal surface, a distal surface, and a bore extending therethrough for receiving the shaft of the multistage pump and positioned so that the distal surface of the diffuser bowl floor and the proximal surface of the diffuser lower shroud form at least a portion of a fluid pathway to the impeller assembly, and a plurality of curved vanes connected to the distal surface of the diffuser bowl floor and positioned between the distal surface of the diffuser bowl floor and the proximal surface of the diffuser lower shroud to reduce kinetic energy of the fluid stream and to convert at least some of the kinetic energy to pressure;

wherein each of the plurality of sand dams have an outer peripheral portion, an inner peripheral portion, and a curved body extending therebetween;

wherein the curved body has an up-flow side, a down-flow side, and an outer surface extending therebetween; and wherein substantial portions of the curved body further have a varying axial thickness to form an substantially convex shape.

6. The diffuser assembly as defined in claim 1, wherein each of the plurality of sand jump ramps is oriented to extend circumferentially in an anticipated approximate upstream direction of sand particles expected to impact the respective sand jump ramp.

7. The diffuser assembly as defined in claim 1, wherein each of the plurality of sand jump ramps is tapered both radially and axially in an anticipated approximate upstream direction of sand particles expected to impact the respective sand jump ramp.

8. The diffuser assembly as defined in claim 1, further comprising at least one sand hole recess extending through the distal surface of the diffuser bowl floor and into a portion of a corresponding at least one of the plurality of sand dams so that when the at least one sand dam is substantially eroded by trapped sand the sand hole recess forms a sand pathway therethrough.

9. The diffuser assembly as defined in claim 8, wherein the at least one sand hole recess further extends through an adjacent at least one curved vane separately connected to or integral with the distal surface of the diffuser bowl floor.

10. The diffuser assembly as defined in claim 1, wherein the inner surface of the diffuser bowl outer wall includes an annular groove extending along an inner circumference of the inner surface of the diffuser bowl outer wall adjacent an outer peripheral portion of each of the plurality of sand dams to enhance return of the trapped sand particles to the primary fluid stream.

11. The diffuser assembly as defined in claim 1, wherein the inner surface of the diffuser bowl outer wall includes a plurality of recesses each spaced apart circumferentially and positioned adjacent an outer peripheral portion of a separate one of the plurality of sand dams to enhance return of the trapped sand particles to the primary fluid stream.

12. A submersible multistage pump for pumping a fluid having a substantial sand content, each of a plurality of stages of the multistage pump comprising:

an impeller assembly comprising an upper impeller body, a lower impeller body, and a fluid passageway formed therebetween; and a diffuser assembly comprising:

a diffuser bowl including:

a diffuser bowl floor having a proximal surface, a distal surface, and a bore extending therethrough, and a diffuser bowl outer wall extending axially from the diffuser bowl floor to house the impeller assembly, a diffuser lower shroud having a proximal surface, a distal surface, and a bore extending therethrough, the distal surface of the diffuser bowl floor and the proximal surface of the diffuser lower shroud forming at least a portion of a fluid pathway to the impeller assembly, a plurality of curved vanes connected to the distal surface of the diffuser bowl floor and positioned between the distal surface of the diffuser bowl floor and the proximal surface of the diffuser lower shroud to reduce kinetic energy of a primary fluid stream and to convert at least some of the kinetic energy to pressure, a plurality of circumferentially spaced anti-swirl ribs defining a plurality of sand dams connected to the proximal surface of the diffuser bowl floor, each of the plurality of sand dams positioned adjacent a separate portion of an inner surface of the diffuser bowl outer wall at an acute angle thereto to guide trapped sand particles to the inner surface of the diffuser bowl outer wall and into the primary fluid stream, and a plurality of tapered protuberances extending axially from the proximal surface of the diffuser bowl floor defining a corresponding plurality of sand jump ramps, each sand jump ramp separately positioned adjacent an outer peripheral surface of a corresponding one of the plurality of sand damns and positioned adjacent the separate portion of the inner surface of the diffuser bowl outer wall adjacent the respective one of the plurality of sand dams to deflect trapped sand particles into the primary fluid stream, each sand jump ramp also oriented to extend circumferentially in an anticipated approximate upstream direction of sand particles expected to impact the respective sand jump ramp.

13. The pump as defined in claim 12, wherein each of the plurality of sand dams have an outer peripheral portion, an inner peripheral portion, and a body extending therebetween; and wherein the out peripheral portion of the each of the plurality of sand dams is positioned radially downstream of the inner peripheral portion of the respective sand dam.

14. The pump as defined in claim 12, wherein each of the plurality of sand jump ramps is tapered both radially and axially in an anticipated approximate upstream direction of sand particles expected to impact the respective sand jump ramp.

15. A submersible multi stage pump for pumping a fluid having a substantial sand content, each of a plurality of stages of the multistage pump comprising:

an impeller assembly comprising an upper impeller body, a lower impeller body, and a fluid passageway formed therebetween; and a diffuser assembly comprising:

a diffuser bowl including:

a diffuser bowl floor having a proximal surface, a distal surface, and a bore extending therethrough, and a diffuser bowl outer wall extending axially from the diffuser bowl floor to house the impeller assembly, a diffuser lower shroud having a proximal surface, a distal surface, and a bore extending therethrough, the distal surface of the diffuser bowl floor and the proximal surface of the diffuser lower shroud forming at least a portion of a fluid pathway to the impeller assembly, a plurality of curved vanes connected to the distal surface of the diffuser bowl floor and positioned between the distal surface of the diffuser bowl floor and the proximal surface the diffuser lower shroud to reduce kinetic energy of a primary fluid stream and to convert at least some of the kinetic energy to pressure, a plurality of circumferentially spaced anti-swirl ribs defining a plurality of sand dams connected to the proximal surface of the diffuser bowl floor, each of the plurality of sand dams positioned adjacent a separate portion of an inner surface of the diffuser bowl outer wall at an acute angle thereto to guide trapped sand particles to the inner surface of the diffuser bowl outer wall and into the primary fluid stream, and a plurality of sand hole recesses, each sand hole recess extending through the distal surface of the diffuser bowl floor and into a portion of a corresponding one of the plurality of sand dams so that when the respective sand dam is substantially eroded the sand hole recess forms a sand pathway therethrough.

16. A submersible multi stage pump for pumping a fluid having a substantial sand content, each of a plurality of stages of the multistage pump comprising:

an impeller assembly comprising an upper impeller body, a lower impeller body, and a fluid passageway formed therebetween; and a diffuser assembly comprising:

a diffuser bowl including:

a diffuser bowl floor having a proximal surface, a distal surface, and a bore therethrough, and a diffuser bowl outer wall extending axially from the diffuser bowl floor to house the impeller assembly, a diffuser lower shroud having a proximal surface, a distal surface, and a bore extending therethrough, the distal surface of the diffuser bowl floor and the proximal surface of the diffuser lower shroud forming at least a portion of a fluid pathway to the impeller assembly, a plurality of curved vanes connected to the distal surface of the diffuser bowl floor and positioned between the distal surface of the diffuser bowl floor and the proximal surface the diffuser lower shroud to reduce kinetic energy of a primary fluid stream and to convert at least some of the kinetic energy to pressure, and a plurality of circumferentially spaced anti-swirl ribs defining a plurality of sand dams connected to the proximal surface of the diffuser bowl floor, each of the plurality of sand dams positioned adjacent a separate portion of an inner surface of the diffuser bowl outer wall at an acute angle thereto to guide trapped sand particles to the inner surface of the diffuser bowl outer wall and into the primary fluid stream, wherein the inner surface of the diffuser bowl outer wall includes an annular groove extending along an inner circumference of the inner surface of the diffuser bowl outer wall adjacent an outer peripheral portion of each of the plurality of sand dams to enhance return of the trapped sand particles to the primary fluid stream.

17. A method of pumping a fluid having a substantial sand content, the method comprising the steps of:

providing a submersible pump having a plurality of diffusers each having a diffuser bowl including: a diffuser bowl floor having a proximal surface and a distal surface, a diffuser bowl outer wall extending axially from the diffuser bowl floor, a plurality of circumferentially anti-swirl ribs defining a plurality of spaced sand dams each connected to the proximal surface of the diffuser bowl floor and positioned adjacent a separate portion of an inner surface of the diffuser bowl outer wall at an acute angle thereto to guide trapped sand particles to the respective separate portion of the inner surface of the diffuser bowl outer wall and into a primary fluid stream, and a plurality of tapered protuberances extending axially from the proximal surface of the diffuser bowl floor defining a corresponding plurality a sand jump ramps, each sand jump ramp separately positioned adjacent an outer peripheral surface of a corresponding one of the plurality of sand dams and positioned adjacent the separate portion of the inner surface of the diffuser bowl outer wall adjacent the respective one of the plurality of sand dams to deflect the trapped sand particles into the primary fluid stream;

guiding sand particles to at least one of the plurality of sand dams; and deflecting trapped sand particles trapped between an impeller shroud and the diffuser bowl to an area between an outer rim of the impeller shroud and inner surface of the diffuser bowl outer wall adjacent thereto and into the primary fluid stream.

18. A method as defined in claim 17, wherein the step of deflecting trapped sand particles includes deflecting the trapped sand particles into an annular groove in the respective separate section of the inner surface of the diffuser bowl outer wall.

19. A method as defined in claim 17, further comprising the steps of:

forming a sand hole recess extending through the distal suffice of the diffuser bowl floor and into an outer peripheral portion of one of the plurality of sand dams so that when the respective outer peripheral portion of the sand dam is substantially eroded the sand hole recess forms a sand pathway therethrough; and passing the trapped sand particles into a primary fluid passageway in an adjacent diffuser responsive to sand particles eroding the outer peripheral portion of the respective sand dam having the sand hole recess extending therein.

* * * * *